United States Patent [19]

Cooper

[11] 4,320,844

[45] Mar. 23, 1982

[54] RELEASABLE LOCKING SYSTEM

[76] Inventor: Michael F. A. Cooper, 13 Waverley Close, Kidderminster, Worcestershire, England

[21] Appl. No.: 803,998

[22] Filed: Jun. 6, 1977

[30] Foreign Application Priority Data

| | | | |
|---|---|---|---|
| Jun. 10, 1976 | [GB] | United Kingdom | 23957/76 |
| Jun. 19, 1976 | [GB] | United Kingdom | 25519/76 |
| Aug. 11, 1976 | [GB] | United Kingdom | 33345/76 |

[51] Int. Cl.[3] ..... B65D 51/16; B65D 53/00; B65D 55/12

[52] U.S. Cl. ..... 215/260; 215/217; 215/342; 215/343; 215/DIG. 1

[58] Field of Search ..... 215/217, 218, 222, 330, 215/329, 337, 339, 260, 307, 315, 342, 343, DIG. 1; 220/208, 209

[56] References Cited

U.S. PATENT DOCUMENTS

| | | | |
|---|---|---|---|
| 2,776,066 | 1/1957 | Thornton | 215/217 |
| 3,072,276 | 1/1963 | Nichols | 215/222 |
| 3,114,467 | 12/1963 | Montgomery | 215/260 |
| 3,339,770 | 9/1967 | Weisand | 215/222 |
| 3,393,818 | 7/1968 | McIntosh | 215/260 |
| 3,610,454 | 10/1971 | Malick | 215/330 |
| 3,628,704 | 12/1971 | Corsette | 215/343 |
| 3,716,161 | 2/1973 | Julian et al. | 215/217 |
| 3,746,199 | 7/1973 | Hart et al. | 215/337 |
| 3,809,276 | 5/1974 | Landen | 215/330 |
| 3,888,376 | 6/1975 | Cooke | 215/217 |
| 3,952,899 | 4/1976 | Cooke | 215/217 |

FOREIGN PATENT DOCUMENTS

| | | | |
|---|---|---|---|
| 2409399 | 9/1974 | Fed. Rep. of Germany | 215/329 |
| 932356 | 7/1963 | United Kingdom | 215/260 |
| 960443 | 6/1964 | United Kingdom | 215/344 |
| 1161322 | 8/1969 | United Kingdom | 215/222 |

*Primary Examiner*—Allan N. Shoap
*Attorney, Agent, or Firm*—Albert L. Jeffers

[57] ABSTRACT

A container closure system such that an uninstructed person would find it difficult to remove the closure. Helical screw threads on the container and on the one-piece closure have detents and discrete thread portions engageable under the influence of a spring means once the closure has been screwed onto (cap) or into (stopper) the container to a certain extent. Unscrewing can only be effected by firstly overcoming the spring means to separate the locking detents/thread portions and subsequently turning the closure while continuing to overcome said spring means.

1 Claim, 13 Drawing Figures

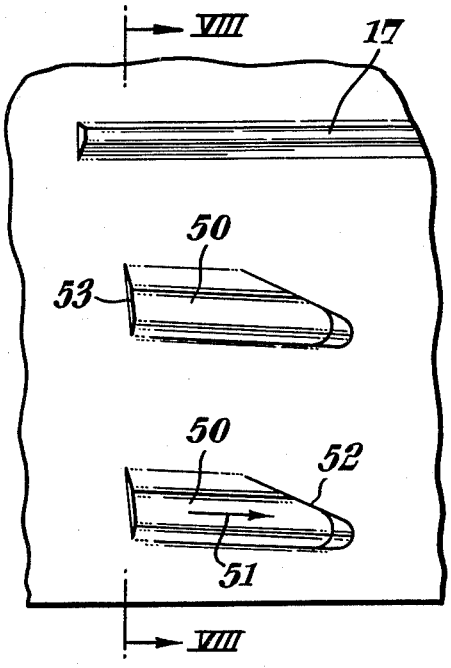
Fig. 7.
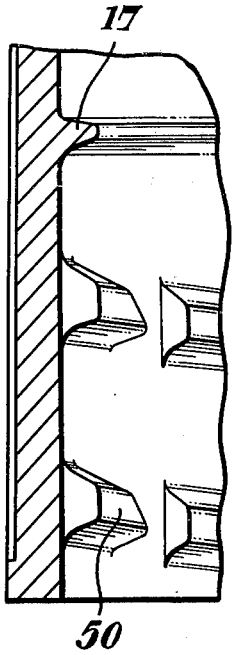
Fig. 8.
Fig. 9.
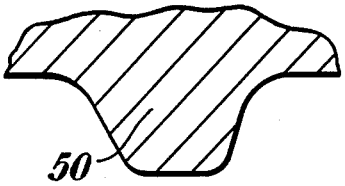

RELEASABLE LOCKING SYSTEM

This invention relates to a child-resistant safety closure system for a container.

Many attempts have been made to make it impossible or very difficult for children and others accidentally to open a container which contains any potentially harmful product such for example, as a medicinal preparation, weedkillers, bleaches and disinfectants and a great number of these attempts have involved the use of a multi-part cap or closure member which co-operates with a standard screw-thread on the neck of the container.

However, not all of the releasable locking systems proposed by others have a widespread application; for example, those closures suitable for use with containers containing gassy (carbonated) liquids are not also suitable for use with containers which contain liquids that generate gas and which for safety reasons (namely, gas build-up can in certain instances, lead to an eventual container explosion) requires the closure/container to be of the vented type to provide gas dispersal without liquid leakage. Moreover, other types of systems are suitable for use with only tablets or dry powder preparations.

The principal object of the present invention is to provide a fail-safe child-resistant system which is capable of being applied to screw-type cap or stopper closures and also to such containers as bottles (whether they be manufactured from plastics, metal, glass or other materials that are commonly used in container manufacture), all to the end that such containers and closures when assembled should provide adequate child-resistance to eliminate or at least to reduce the incidence of accidents. It is a subsidiary object of the present invention that the closure by being screwed onto or into the container will automatically effect a positive lock after little over half of one complete revolution.

According to a first aspect, the present invention consists in a system for releasably locking a container and a closure member to one another, said system comprising a helical screw thread on each of said container and said closure member, a first one of said helical screw threads being constituted by at least two discrete thread portions, the second of said helical screw threads having a detent, and a compressible spring device carried by one of said container and said closure member, the connection of said container and said closure member to one another by the interlocking of said helical screw threads causing sufficient power to be stored in said compressed spring device to cause a reversible relative axial movement between said detent and said thread portions to position said detent between two adjacent thread portions and thereby to prevent reverse (unscrewing) rotation of one of said container and said closure member relative to the other.

In one embodiment, there may be a number of detents instead of a single detent, and the spacing of said detents from one another circumferentially of the respective one of the two members may be equal or unequal. However, in a preferred embodiment, there are two equally spaced detents. Moreover, from a practical point of view, the maximum feasible number of spaced detents will depend on the length of the circumference along which they are to be placed (namely, on the diameter of the container or container neck and that of the cap or other closure member) and, for moderately sized concentrically arranged members like the neck of a container and a cap to be applied to said neck to close the container, it is thought that three or four detents, equally spaced or otherwise, will possibly be the maximum number of detents employable.

In an alternative embodiment, said detent, or detents may be formed by a discrete thread portion or by a number of discrete thread portions, respectively, said discrete thread portion(s) constituting at least part of said second helical screw thread.

The discrete thread portions which collectively constitute the first helical screw thread need not be of identical dimensions when measured along their respective crests along the helix. In a generally preferred embodiment, said thread portions will be identical with one another, but in one alternative embodiment, there will be at least one thread portion whose crest dimension measured along the helix is a multiple of the corresponding crest dimension of each of some or all of the remaining thread portions.

The form of the second helical screw thread may be, for example, such as to have a thread angle of 60° with rounded crests and roots. Such a thread form has been found to be particularly suitable, the said second helical screw thread being applied either to the neck of the container or to the closure member therefor. The detent(s) which is/are formed integrally with the second helical screw thread in said one embodiment may be of special form because of the requirement for engagement thereby of the respective thread portion(s) of the first helical screw thread; for example, such engagement may be in a manner similar to that of a pawl and ratchet wheel. Said special form will be described hereinafter by reference to the drawings.

The form of said at least two thread portions which constitute the first helical screw thread is also special. Thus, each thread portion, regardless of its crest dimension when measured along the helix, consists of a thread having a flat crest and a basically trapezoidal cross-section over at least a first part of said dimension if not over the whole of said dimension; where there is a change in said cross-sectional shape at the end of said first part of said dimension, the cross-sectional area of the thread portion over the second part of said dimension may become progressively reduced by virtue of the fact that said second part is sloped to provide a cam surface. Regarding the basic root of the thread portion as truly parallel to the crest thereof, one flank of the thread portion in a preferred form thereof makes an included angle of 60° with the long side of the trapezium and the other flank thereof makes an includes angle of 75° therewith.

The spring device may take many forms and its form will, to some extent, be dictated by the application in which use of the present invention is made and also by the price. A form of spring device which has been found to be suitable is a wad of a synthetic resin material or an elastomer (the material chosen preferably being foamed) but other examples of suitable spring devices are a "Belleville" washer or a stainless steel spring. If the spring device is to be accommodated adjacent the crown of a screw cap of a bottle, a wad of chip-foam or polyacetal material for example, would be ideal, but said spring device could be integral with (for example, moulded as part of) the cap.

A thread-winding stop may be incorporated if desired and in certain uses of the present invention be highly desirable. Said stop could be provided on the container or on the closure member.

Some commodities (for example, expensive alcoholic beverages) are also provided with additional pilfer-proof or tamper-proof caps which are such that, when the cap is rotated in the unscrewing direction, a ring becomes broken off along a weakened line, and this gives the customer a visual check when buying the goods that the container has not been tampered with in any way. Accordingly, the system which is the subject of the present invention could also include such pilfer-proof or tamper-proof arrangements.

According to a second aspect, the present invention consists in a container of the type having a helical screw thread for engagement with a complementary closure member, said container having as part of said helical scew thread at least one detent which is such as to effect locking engagement with a portion of said helical screw thread which is on said closure member. Said detent may take any of the forms described in this Specification either by reference to the accompanying drawings or without reference to said drawings.

According to a third aspect, the present invention consists in a closure member of the type having a helical screw thread for engagement with a complementary helical screw thread carried by a container, said helical screw thread on said closure member being constituted by at least two discrete thread portions.

Said discrete thread portions may take any form as described in this Specification, either by reference to or without reference to the accompanying drawings.

The helical screw threads mentioned in any one of the thirteen preceding paragraphs may be single-start or multiple-start threads.

The present invention will now be more particularly described with reference to the accompanying drawings, in which:

FIG. 7 is an enlarged view of the screw-thread elements;

FIG. 8 is a section on the line VIII—VIII in FIG. 7;

FIG. 9 is an enlarged section of one of said thread segments and showing the shape of said thread section.

Figure 1:
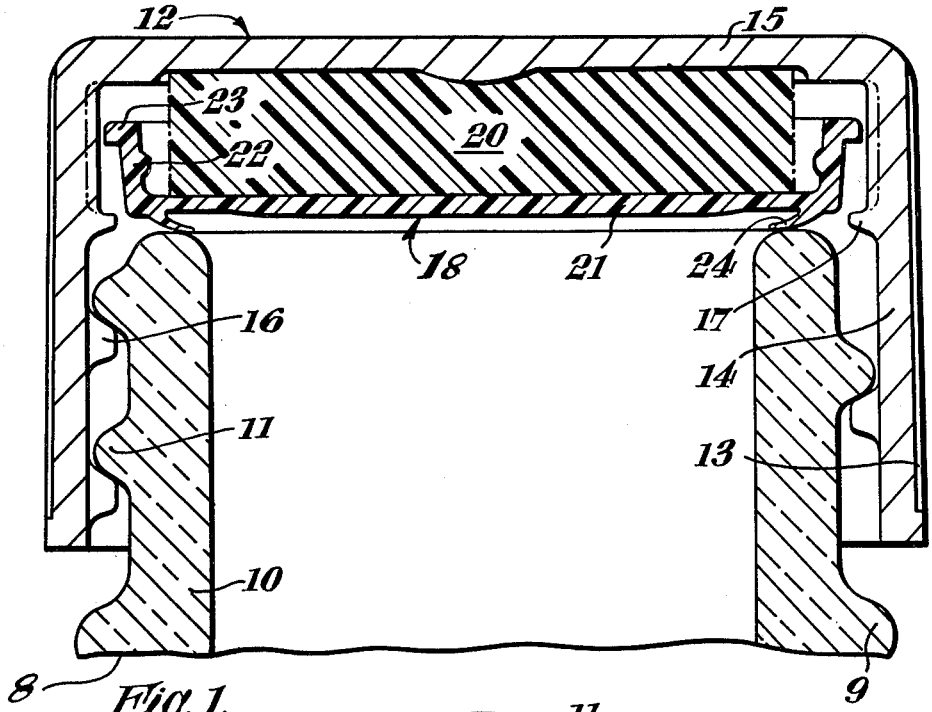
FIG. 1 illustrates in section one exemplary embodiment which makes use of the present invention, namely, the uppermost portion of the neck of a container which has been closed by a closure member.

Referring to FIG. 1, there is illustrated the upper end of the neck 10 of a glass container 8 which is not otherwise illustrated, said neck having the usual transfer ring 9 and an exterior helical screw thread 11 of a form which will hereinafter be described in detail. A one-piece closure member or cap 12 preferably having a knurled exterior 13 comprises a skirt portion 14 and a crown portion 15, said portions being integral with one another. A helical screw thread 16 is formed on the interior surface of said cap and the precise form of said screw thread will be described hereinafter. Also formed on said cap is a pair of radially inwardly projecting ledges 17 each of which extends over an arc of 90° and which are equally spaced from one another.

In the preferred embodiment of the invention, a compressible spring device 20 is accommodated in a space between the inner surface of the crown portion 15 and the opposed surface of a liner 18 whose cross-sectional shape is illustrated in FIG. 1. It will be seen from that Figure that the liner is in the form of a shallow cup consisting of a disc-like base 21 formed integrally with an annular wall 22 which terminates in an annular and radially outwardly projecting lip 23. At or near the junction of the base 21 and the annulus 22, there is disposed a ring 24 which is an integral part of the liner and which projects axially downwardly and also radially inwardly and whose thickness in section decreases from the maximum where said ring is joined to said base to the minimum at the free periphery thereof.

The ledges 17 are for the support and retention of the liner which in turn supports and retains the spring device 20. If said liner/spring device combination were to be replaced by an alternative form of liner/spring device, it might not be necessary to provide the ledges 17 because other arrangements could be employed for the support and retention of said alternative liner/spring device. Thus, by way of example, said alternative liner/spring device could be in the form of an annular washer comprising a compressible elastic material (e.g. rubber) which is covered with aluminium foil, the hole in the annular washer being a press-fit on a boss which is integral with the crown portion 15 of the closure member, the foil-covered face of the washer being intended to be brought into contact with the uppermost edge or rim of the neck of the container.

As is known in the closeable container field, the liner becomes distorted under the pressure exerted thereon between the edge or rim of the container and the crown portion of the closure member, said distortion providing the necessary seal. The materials used in the manufacture of known liners may be employed in the system according to the invention if the material(s) give a sufficiently strong spring effect.

The container may be of a glass bottle or a bottle moulded from high-impact styrene, these two materials being mentioned by way of example only.

The helical screw thread 11 may be of a conventional form such for example as a metric or American National thread form. In the chosen exemplary embodiment, the thread angle is 60°, the helix angle is 3° 33′, the thread pitch is 5, 1 mm and the thread extends over 1¼ turns.

Figure 2:
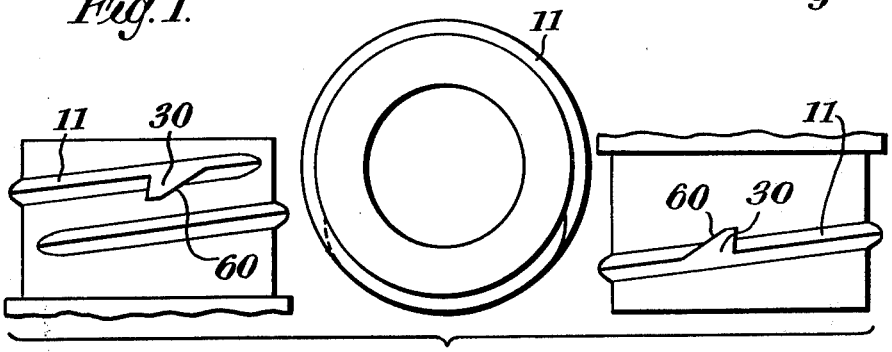
FIG. 2 illustrates, in two side elevations and in plan, the helical screw-thread with which the neck of the container is provided, said screw thread having two integral detents.
Figure 3:
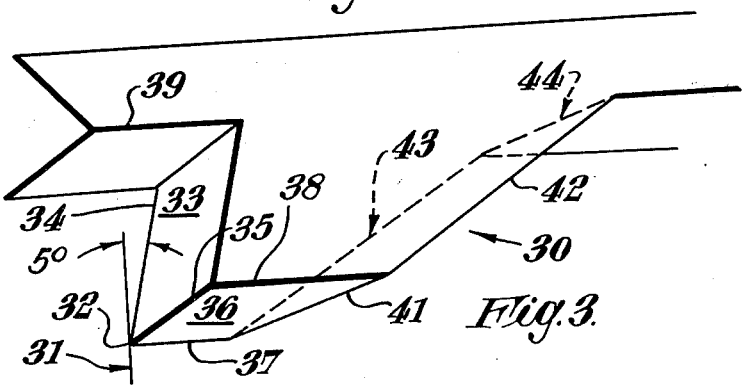
FIG. 3 is a perspective view, drawn to a considerably enlarged scale, of the detent in FIG. 2.
Figure 4:
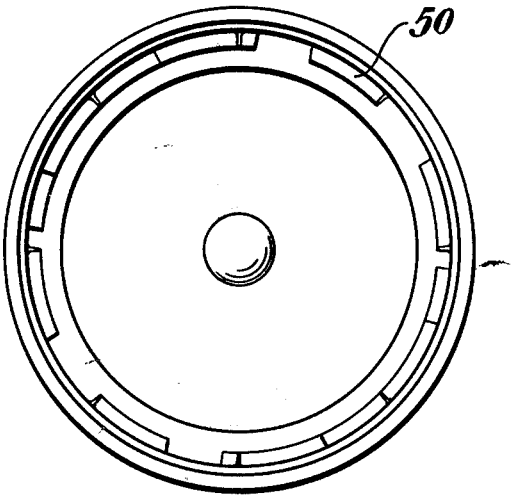
FIG. 4 illustrates a view of the cap looking from the open end thereof towards the crown thereof.
Figure 5:
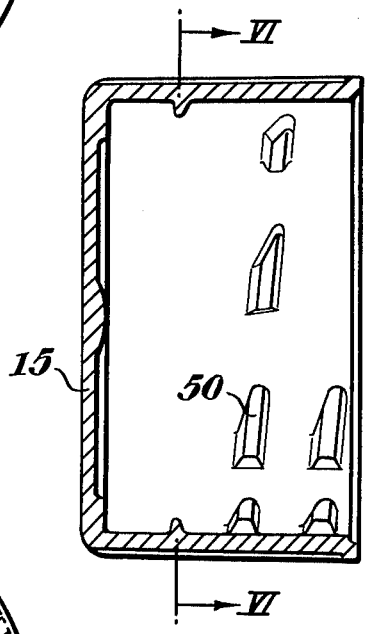
FIG. 5 is a section on the centre line of said cap.
Figure 6:
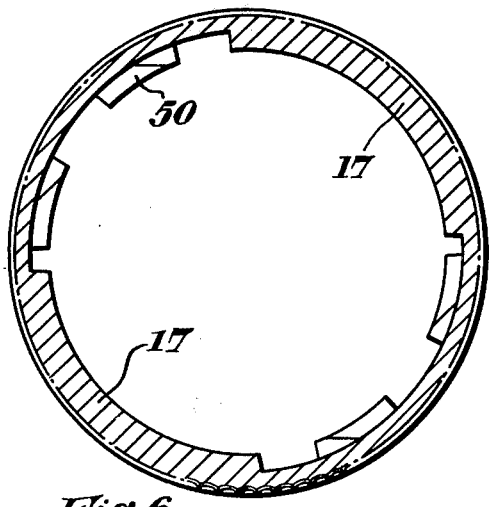
FIG. 6 is a cross-section of the cap shown in FIG. 5 and taken on the line VI—VI in said FIG. 5.

The screw thread 11 incorporates two diametrically opposed detents 30 (see FIG. 2) each of which is shaped in the manner illustrated in FIG. 3. Considering the diametrical plane 31 (FIGS. 2 and 3) which contains the longitudinal axis of the container, said plane passes through the point 32 (FIG. 3) which is at one corner of a four-sided plane face 33 of the detent 30. Said plane face 33 is so tilted away from said plane 31 that not only does the side 34 thereof make an included angle of 5° with said plane 31 but also the side 35 makes an included angle of 5° with said plane 31.

The plane surface 36 is bounded by four sides of which the two sides 37, 38 are parallel to one another and to the crest 39 of the screw thread 11, with the result that said plane surface is normal to the plane 31. Said surface slopes upwardly and outwardly at an angle of 30°.

An angled plane surface is bounded by the full lines 41, 42 and by the dotted lines 43, 44 and of said lines the dotted line 43 makes an included angle of 25° with the extension of the side 37. Said angled plane surface makes an included angle of 95° with the plane which contains not only the side 34 of the surface 33 but also the side 37 of the surface 36 and the side 43 of said angled plane.

The converging slopes of the surfaces 33 and 36 and said angled surface facilitate separation of the split-mould parts from the moulded container neck.

Referring now to FIGS. 4 to 9, the closure member or cap 12 is illustrated therein. Said closure member 12 comprises the helical screw thread 11 which will be seen to be constituted by a plurality of thread portions 50, all of identical shape and dimensions. As said closure member will need to be moulded with the use of a collapsible core, the thread portions 50 must not only be able to perform their screw-thread function but also be so shaped as to facilitate extraction of the mould parts. One suitable form for each of the thread portions 50 is illustrated in FIG. 7 for example and has a length dimension, measured along the crest along the helix (namely, in the direction indicated by the arrow 51) which is divided into two substantially equal parts of which one is of substantially uniform trapezoidal cross-section (see FIG. 9) and of which the other is of a non-uniform cross-section. The two conjoined parts thus constitute a thread portion which includes a cam surface 52, the angle of 25° of said cam surface relative to the angle of inclination of the helical screw thread matching that of the dotted line 43 of the detent 30 described with reference to FIGS. 2 and 3. Likewise, an end face 53 of each thread portion is raked at an angle of 5° relative to a plane containing the longitudinal axis 54 of the closure member (see FIGS. 5 and 7) and said angle matches the angle which the side 34 makes with the plane 31. Moreover, said face 53 also slopes in a manner which is complementary to the 5° slope of the face 33 (see FIG. 3) which results from said side 35 being canted 5° out of the vertical.

It will be appreciated that, in order to close an open container by use of the system of the present invention, the closure member 12 is applied to the container neck 10 and is rotated relative thereto in the direction appropriate to cause the two helical screw threads 11, 16 to become interlocked or engaged. In so doing, the thread portions 50 will freely ride past the detents 30 until the spring device 20 becomes compressed as a result of the rim of the neck 10 making contact with and moving the liner. When such compression takes place, the spring device 20 will urge the closure member 12 axially away from the neck 10 and this will have the effect of causing the cam surfaces 52 of the respective thread portions 50 to ride along the sloping surfaces 60 (FIG. 2) of the detents 30 until the faces 53 of said respective thread portions fall off the high parts of the diametrically opposed detents. In this manner, each of the detents becomes positioned between two adjacent thread portions 50.

Compression of the spring device 20 takes place after approximately one half of one complete revolution of the closure member relative to the container neck. Once such compression has taken place, the detents and the thread portions will be forced to engage one another; further relative rotary movement between the closure member and the container in the screwing-up direction is possible by virtue of the coacting sloped surfaces 52, 60. However, unscrewing of the closure member by any attempted simple rotational movement of the closure member will be prevented by spring-maintained engagement between the surfaces 33, 53. Unlocking of the closure member is possible only by combined axial and angular movements of the closure member relative to the neck of the container; these combined movements are obtained by initially pushing the closure member 12 onto the neck 10 in order not only to compress the already compressed spring device 20 to an even greater extent but also to cause disengagement of the respective engaged surfaces 33, 53. Once there is no longer engagement between the detents 30 and the respective thread portions 50, the closure member 12 can be rotated to unscrew it from the container neck; however, the pushing force must be maintained whilst the closure member is rotated because otherwise the lock will become re-applied by the spring device 20.

Of course, the illustrated arrangement could be reversed; thus, the helical screw thread 11 having the detents 30 could be formed on the closure member and the interrupted helical screw thread 16 (constituted by the thread portions 50) could be formed on the neck 10 of the container.

Instead of the spring device being located within the closure member, as illustrated, a suitably manufactured spring device could be supported by the container; for example, an annular spring device could be supported by the transfer ring 9 or by any equivalent thereof.

The detent or detents which coact with the interrupted helical screw thread 16 (whether said thread 16 is on the container or on the closure member) could be provided by another interrupted helical screw thread. This would obviate the use of detents of the kind illustrated in FIGS. 2 and 3 and would necessitate the use, for example, of a helical screw thread 11 similar to or identical with the screw thread 16, or indeed of some other and quite different form.

As illustrated in FIGS. 4 to 9, the thread portions 50 are of equal dimensions measured along their crests in the direction of the arrow 51. However, they need not be of equal dimensions and this condition can give rise to a certain advantage which will be explained below.

Figure 10:
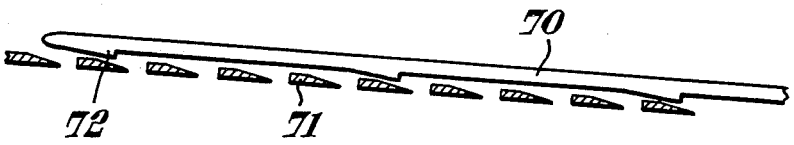
FIGS. 10 to 13 are developments of the mating or complementary helical screw threads which are used in two different embodiments of the present invention.
Figure 11:
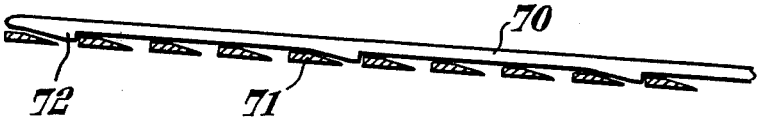

Referring firstly to FIGS. 10 and 11, it will be assumed that the helical screw thread 70 is carried by the container and that the helical screw thread 71 is carried by the closure member. The detents 72 will click over and past the thread portions which constitute the thread 71 during the screwing-up action and can come to rest in the relative positions shown in FIG. 10. As soon as there is any unscrewing of the closure member without compression of the spring device, the detents 72 will positively engage the respective equal-sized thread portions (FIG. 11).

Figure 12:
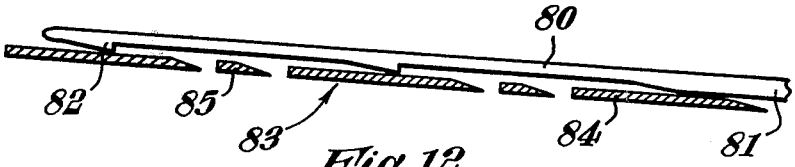
Figure 13:
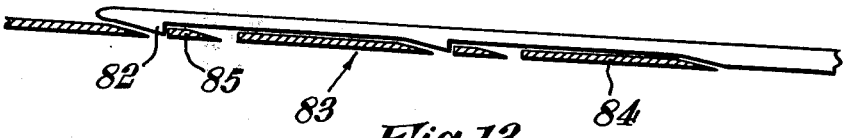

However, in FIGS. 12 and 13, there is illustrated an arrangement in which the helical screw thread 80 carried by the container is provided with a land portion 81 in addition to detents 82 and in which the helical screw thread 83 carried by the closure member comprises (by way of example only) three long thread portions 84 and two short thread portions 85. Whereas one could with luck, obtain an airtight seal between the rim of the neck of the container and the liner or other sealing device with the thread configuration of FIGS. 10 and 11, such a seal is made certain by the thread configuration of FIGS. 12 and 13; this is because the detents 82 and the land 81 in FIG. 12 are in contact with the long thread portion 84, thereby providing the same sealing action as is provided by conventional engaged helical screw threads. FIG. 13 simply demonstrates that, upon attempted unscrewing of the closure member by a child, the lock becomes operative.

The so called "backing off" of closures (due, for example to vibration during transport) is prevented by use of the system according to this invention.

The closure member illustrated in FIG. 1 will give a liquid-tight seal between the rim of the neck 10 and the flexible ring 24 with the added facility of the closure being vented or capable of being vented by virtue of the fact that the lip 23 is not in contact with the crown portion 15. Thus, gas generated for example by a powerful bleaching preparation can cause a build-up of pressure in the closed container and this build-up could in time, further compress the spring device 20 to provide a self-venting liquid-tight container. On the other handle, if a gas-tight container is required, the arrangement can be modified to enable the lip 23 to seal against the crown portion 15.

What I claim is:

1. Apparatus for releasably locking a container member having a neck with a rim defining an opening at one end thereof and a closure member for covering said opening comprising:

first means being on said container member for providing first surfaces;

second means being on said closure member for providing second surfaces registrably engageable with said first surfaces and for effecting a fastening closure between said members;

a liner interposed between said closure member and container rim having a planar disc substantially coextensive with said container opening with a depending peripheral resilient ring engageable with the rim of the container neck surrounding said container opening; the edges of said ring being deflectable towards said disc upon engagement with said container rim;

third means for movably supporting said liner in said closure member;

a spring member being between said liner and the inner surface of said closure member to resiliently urge said liner towards said rim and resiliently yieldable to provide fluid escape under a predetermined fluid pressure and thereby prevent fluid pressure in the container from exceeding said predetermined pressure.

* * * * *